US008985570B1

(12) United States Patent
Fang et al.

(10) Patent No.: US 8,985,570 B1
(45) Date of Patent: Mar. 24, 2015

(54) PAPER FEEDING MECHANISM

(71) Applicant: Foxlink Image Technology Co., Ltd., New Taipei (TW)

(72) Inventors: Jing Hua Fang, New Taipei (TW); Wen Ching Liao, New Taipei (TW); I Chuan Hong, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 14/180,838

(22) Filed: Feb. 14, 2014

(51) Int. Cl.

| | |
|---|---|
| ***B65H 3/34*** | (2006.01) |
| ***B65H 9/06*** | (2006.01) |
| ***B65H 1/04*** | (2006.01) |
| ***B65H 3/56*** | (2006.01) |
| ***B65H 9/04*** | (2006.01) |

(52) U.S. Cl.
CPC .. *B65H 9/06* (2013.01); *B65H 1/04* (2013.01); *B65H 3/56* (2013.01); *B65H 9/04* (2013.01)
USPC ..... 271/167; 271/165; 271/121; 271/124

(58) Field of Classification Search
CPC ..... B65H 1/04; B65H 3/56; B65H 9/04; B65H 9/06
USPC ..... 271/145, 121, 124, 165, 167
See application file for complete search history.

(56) References Cited

U.S. PATENT DOCUMENTS

| | | | | |
|---|---|---|---|---|
| 4,971,310 | A * | 11/1990 | Motegi et al. | 271/126 |
| 5,906,366 | A * | 5/1999 | Chang | 271/124 |
| 6,029,972 | A * | 2/2000 | Chang | 271/124 |
| 8,210,523 | B2 * | 7/2012 | Maekawa et al. | 271/126 |
| 8,708,327 | B2 * | 4/2014 | Suzuki et al. | 271/23 |

* cited by examiner

*Primary Examiner* — Prasad Gokhale
(74) *Attorney, Agent, or Firm* — WPAT, P.C.; Anthony King

(57) ABSTRACT

A paper feeding mechanism includes a mechanical frame, a gear assembly, a paper supply tray, a pickup assembly, a paper pressing assembly and a stopper assembly. The gear assembly includes a drive gear and a transmission gear. The paper pressing assembly includes a paper pressing frame, a paper pressing tray, a gear shaft, at least one swing arm and an elastic element. The stopper assembly includes a blocking element and a connecting element. The drive gear drives the transmission gear and the gear shaft to rotate, the connecting element drives the blocking element to move downward to make the blocking element realize a paper blocking function, and the drive gear breaks away from the drive gear, the elastic element pushes against the paper pressing tray to move downward, the blocking element breaks away from the paper supply tray to raise up for making the paper blocking function disappeared.

10 Claims, 4 Drawing Sheets

PAPER FEEDING MECHANISM

BACKGROUND OF THE INVENTION

1. Field of the Invention

The present invention generally relates to a paper feeding mechanism, and more particularly to a paper feeding mechanism with a paper blocking function.

2. The Related Art

A traditional paper feeding mechanism driven by a driving device (not shown), includes a mechanical frame, a paper supply tray, a gear assembly, a pickup assembly, a paper pressing assembly and a stopper assembly. The paper supply tray, the gear assembly, the paper pressing assembly and the stopper assembly are respectively mounted to the mechanical frame. The pickup assembly is assembled to the mechanical frame and the paper supply tray. The gear assembly transmits driving force generated by the driving device to the pickup assembly, the paper pressing assembly and the stopper assembly to realize a paper feeding function. The driving device is designated as a plurality of motors.

However, the above-mentioned paper feeding mechanism realizes the paper feeding function by virtue of the gear assembly transmitting the driving force generated by a plurality of motors to the pickup assembly, the paper pressing assembly and the stopper assembly that makes the paper feeding mechanism have a more complex structure and a higher manufacturing cost.

SUMMARY OF THE INVENTION

An object of the present invention is to provide a paper feeding mechanism. The paper feeding mechanism includes a mechanical frame, a gear assembly mounted to the mechanical frame, a paper supply tray, a pickup assembly, a paper pressing assembly and a stopper assembly. The gear assembly includes a drive gear, and a transmission gear engaged with the drive gear. A rear end of the paper supply tray is pivoted to the mechanical frame. The pickup assembly is assembled to the mechanical frame and the paper supply tray, and a top of the pickup assembly projects above a top surface of the paper supply tray. The paper pressing assembly is driven by the gear assembly, and mounted to the mechanical frame and located above the paper supply tray. The paper pressing assembly includes a paper pressing frame disposed above the paper supply tray, a paper pressing tray mounted inside of the paper pressing frame, a gear shaft mounted to the paper pressing frame and connected with the transmission gear, at least one swing arm mounted to the gear shaft, and an elastic element elastically restrained between the paper pressing frame and the paper pressing tray. One end of the swing arm is mounted to one end of the gear shaft, and the other end of the swing arm is driven by the gear shaft to rotate around the gear shaft and horizontally slides in the paper pressing tray. The stopper assembly is assembled to the paper pressing tray and the paper pressing frame. The stopper assembly includes a blocking element and a connecting element. The blocking element is disposed perpendicular to the paper supply tray and is assembled to the paper pressing frame. One end of the connecting element is pivotally mounted to the paper pressing tray and the other end of the connecting element is pivotally mounted to a top of the blocking element. The drive gear of the gear assembly drives the transmission gear and the gear shaft to rotate to bring along the swing arm to swing and pull the paper pressing tray to raise up to flush with a bottom surface of the paper pressing frame, simultaneously, the elastic potential energy of the elastic element is needed be conquered, the connecting element drives the blocking element to move downward to make the blocking element realize a paper blocking function, the drive gear of the gear assembly breaks away from the drive gear, a binding force of the paper pressing assembly is disappeared, the elastic element pushes against the paper pressing tray to move downward, the blocking element breaks away from the paper supply tray to raise up for making the paper blocking function of the blocking element of the stopper assembly disappeared.

As described above, the drive gear of the gear assembly drives the transmission gear and the gear shaft to rotate to bring along the swing arm to swing and pull the paper pressing tray to raise up to flush with the bottom surface of the paper pressing frame, simultaneously, an elastic potential energy of the elastic element is needed be conquered, the connecting element drives the blocking element to move downward to make the blocking element realize the paper blocking function so as to facilitate placing the paper on the paper supply tray, the drive gear of the gear assembly breaks away from the drive gear, the binding force of the paper pressing assembly is disappeared, the elastic element pushes against the paper pressing tray to move downward, the blocking element breaks away from the paper supply tray to raise up for making the paper blocking function of the blocking element of the stopper assembly disappeared for facilitating picking up the paper. The paper feeding mechanism realizes the paper feeding function by virtue of the gear assembly transmitting the driving force generated by one motor to the pickup assembly, the paper pressing assembly and the stopper assembly so as to make the paper feeding mechanism have a simpler structure and a lower manufacturing cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
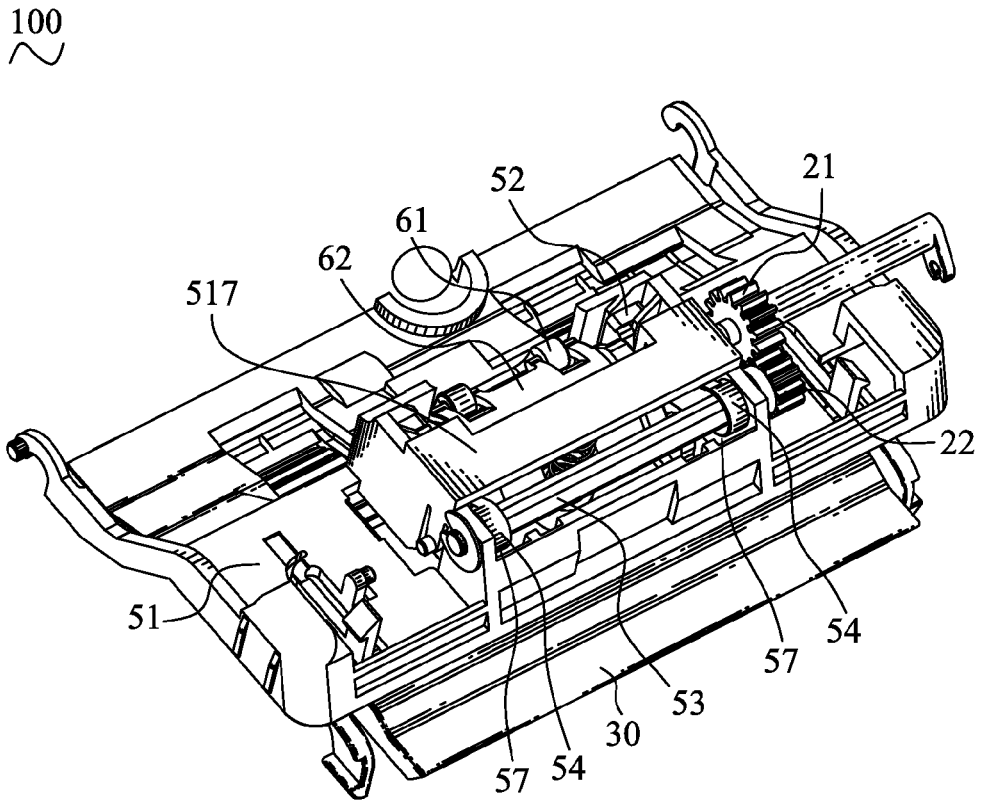
FIG. 1 is a perspective view of a paper feeding mechanism in accordance with an embodiment of the present invention.

With reference to FIG. 1 to FIG. 4, a paper feeding mechanism 100 in accordance with an embodiment of the present invention is shown. The paper feeding mechanism 100 driven by a driving device (not shown), includes a mechanical frame (not shown), a gear assembly 20, a paper supply tray 30, a pickup assembly 40, a paper pressing assembly 50 and a stopper assembly 60 (not shown). The gear assembly 20, the paper supply tray 30, the pickup assembly 40, the paper pressing assembly 50 and the stopper assembly 60 are mounted to the mechanical frame. The gear assembly 20 transmits driving force generated by the driving device to the pickup assembly 40, the paper pressing assembly 50 and the stopper assembly 60 to realize a paper feeding function. In this embodiment, the driving device is designated as one motor.

Figure 2:
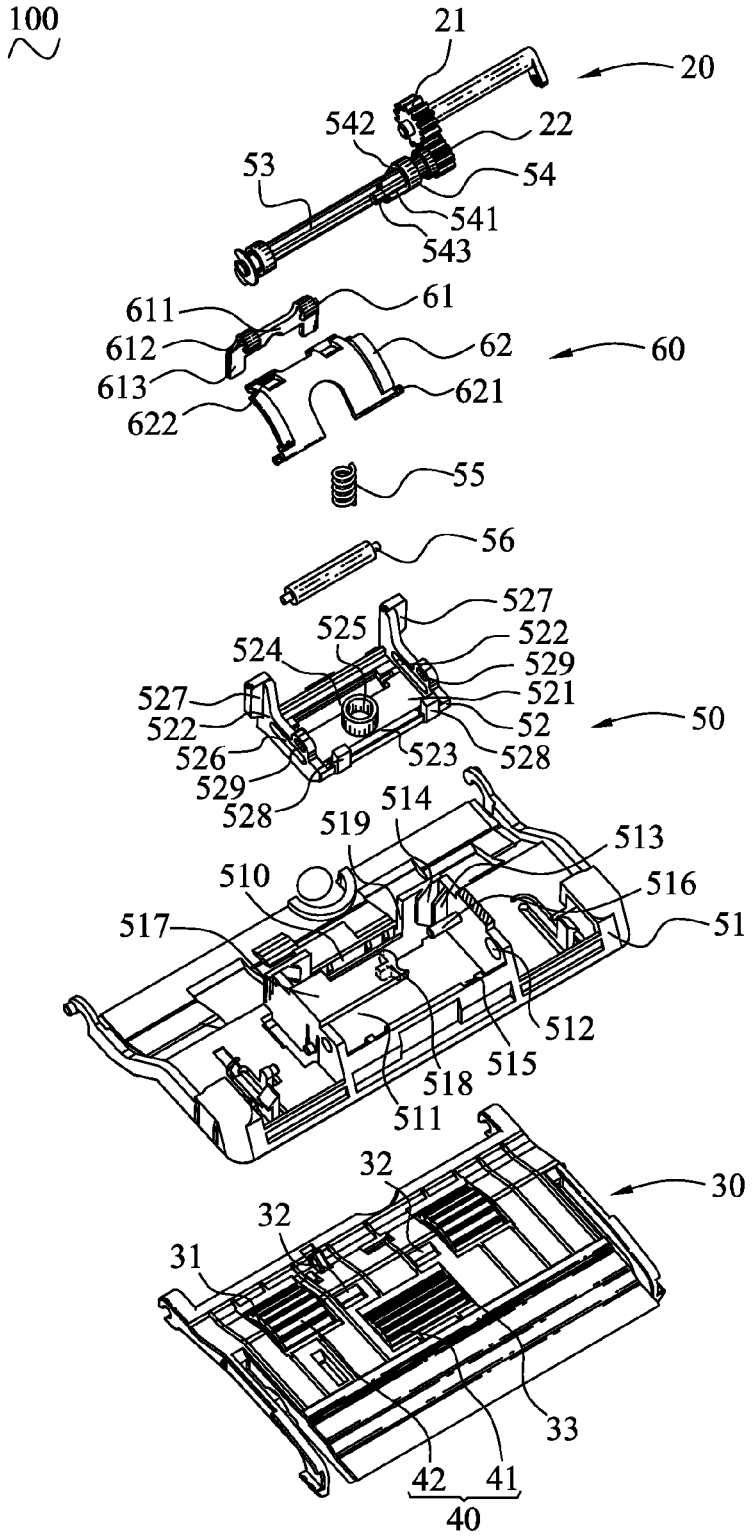
FIG. 2 is an exploded view of the paper feeding mechanism of FIG. 1, wherein a paper pressing frame is partially sectioned.
Figure 3:
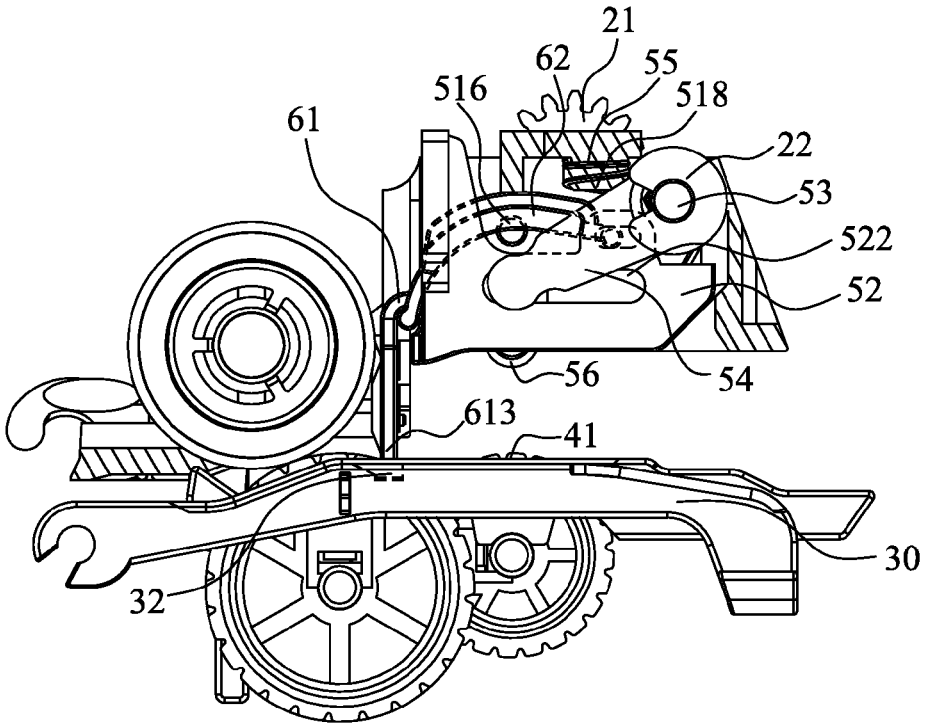
FIG. 3 is a side view showing a placing paper status of the paper feeding mechanism of FIG. 1.
Figure 4:
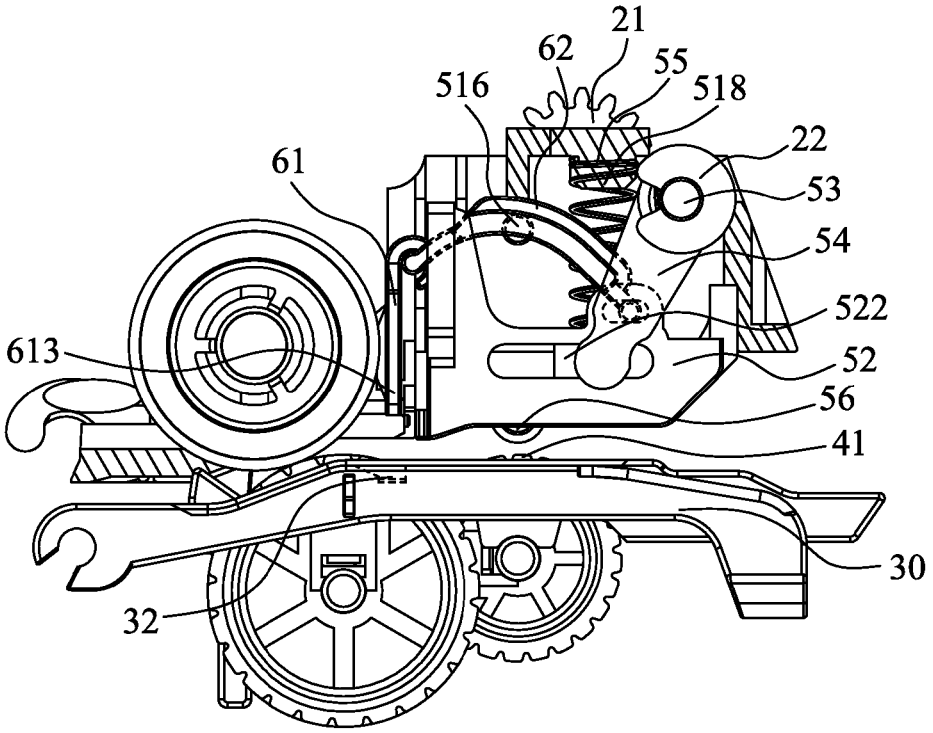
FIG. 4 is a side view showing a picking up paper status of the paper feeding mechanism of FIG. 1.

Referring to FIG. 2, the gear assembly 20 is mounted to one side of the mechanical frame. The gear assembly 20 includes a drive gear 21 driven by the driving device, and a transmission gear 22 engaged with the drive gear 21.

Referring to FIG. 2, a rear end of the paper supply tray 30 is pivoted to the mechanical frame for placing paper therein. The paper supply tray 30 defines two separating grooves 31, two blocking grooves 32 located between the two separating grooves 31, and a picking groove 33 located in front of the two blocking grooves 32.

Referring to FIG. 2, the pickup assembly 40 is assembled to the mechanical frame and the paper supply tray 30, and a top of the pickup assembly 40 projects above a top surface of the paper supply tray 30 and a bottom of the pickup assembly 40 projecting under a bottom surface of the paper supply tray 30. The pickup assembly 40 includes a pickup roller 41, and a plurality of separating rollers 42 located behind the pickup roller 41. The pickup roller 41 passes through the picking groove 33 of the paper supply tray 30 with a top thereof projecting beyond the top surface of the paper supply tray 30. Each of the separating rollers 42 passes through the separating groove 31 of the paper supply tray 30 with a top thereof projecting beyond the top surface of the paper supply tray 30. The pickup roller 41 is capable of being assisted by the paper pressing assembly 50 to grab the paper in a positive force.

Referring to FIG. 1 and FIG. 2, the paper pressing assembly 50 driven by the gear assembly 20, and is mounted to the mechanical frame and is located above the paper supply tray 30. The paper pressing assembly 50 includes a paper pressing frame 51 disposed above the paper supply tray 30, a paper pressing tray 52 mounted inside of the paper pressing frame 51, a gear shaft 53 mounted to the paper pressing frame 51 and connected with the drive gear 21, at least one swing arm 54 mounted to the gear shaft 53, an elastic element 55 elastically restrained between the paper pressing frame 51 and the paper pressing tray 52, and a paper pressing roller 56 pivotally mounted to the paper pressing tray 52 with a bottom thereof projecting under a bottom surface of the paper pressing tray 52. One end of the swing arm 54 is mounted to one end of the gear shaft 53, and the other end of the swing arm 54 is driven by the gear shaft 53 to rotate around the gear shaft 53 and horizontally slide in the paper pressing tray 52. In this embodiment, the paper pressing assembly 50 includes two swing arms 54 mounted to two opposite sides of the gear shaft 53. The transmission gear 22 drives the gear shaft 53 to rotate.

Referring to FIG. 1 and FIG. 2, specifically, the paper pressing frame 51 defines an accommodating groove 511 vertically penetrating through a middle of a front of the paper pressing frame 51. Two fronts of two opposite sidewalls of the accommodating groove 511 of the paper pressing frame 51 define two pivoting holes 512. The two opposite sides of the gear shaft 53 of the paper pressing assembly 50 are pivoted in the two pivoting holes 512. Two rears of two inner surfaces of two opposite sidewalls of the accommodating groove 511 of the paper pressing frame 51 protrude face to face to form two blocking pieces 513. The two blocking pieces 513 are spaced from a rear sidewall of the accommodating groove 511 of the paper pressing frame 51 to form two first guiding grooves 514, and two opposite sides of an inner surface of a front sidewall of the accommodating groove 511 of the paper pressing frame 51 define two second guiding grooves 515. Two inner surfaces of the two opposite sidewalls of the accommodating groove 511 of the paper pressing frame 51 protrude face to face to form two protruding pillars 516 projecting into the accommodating groove 511 of the paper pressing frame 51 and respectively located in front of the blocking pieces 513. Two tops of the two opposite sidewalls of the accommodating groove 511 of the paper pressing frame 51 extend towards each other to form a blocking board 517. A middle of a bottom surface of the blocking board 517 protrudes downward to form a fastening pillar 518. A middle of the rear sidewall of the accommodating groove 511 of the paper pressing frame 51 defines an avoiding groove 519. A rear of the paper pressing frame 51 defines a locating groove 510 communicating with the avoiding groove 519.

Referring to FIG. 1 and FIG. 2, the paper pressing tray 52 of the paper pressing assembly 50 is capable of sliding upward and downward to be slidably assembled to the accommodating groove 511 of the paper pressing frame 51. The paper pressing tray 52 has a bottom board 521, two lateral boards 522 extending upward from two opposite sides of the bottom board 521, and a front board 523 extending upward from a front end of the bottom board 521. A bottom of a front surface of the front board 523 is inclined rearward for facilitating feeding the paper. A rear of a top surface of the bottom board 521 defines a pivoting groove 524 vertically penetrating therethrough. Two opposite sides of the pivoting groove 524 are narrower than a middle of the pivoting groove 524. The paper pressing roller 56 is pivoted in the pivoting groove 524 with a bottom thereof projecting under the bottom board 521 of the paper pressing tray 52. A front of the top surface of the bottom board 521 protrudes upward to form a cylindrical locating barrel 525. Two middles of the two opposite sidewalls of the accommodating groove 511 of the paper pressing frame 51 define two sliding grooves 526 penetrating therethrough. Two rears of the two opposite sidewalls of the accommodating groove 511 of the paper pressing frame 51 protrude outward to form two first guiding blocks 527. Two opposite sides of the front board 523 protrude upward and then protrude forward to form two second guiding blocks 528. Two tops of the two opposite sidewalls of the accommodating groove 511 of the paper pressing frame 51 define two elliptical movable holes 529.

Referring to FIG. 2, the paper pressing tray 52 of the paper pressing assembly 50 is slidably assembled to the accommodating groove 511 of the paper pressing frame 51. The two lateral boards 522 of the paper pressing tray 52 are respectively located at two inner sides of the two opposite sidewalls of the accommodating groove 511 of the paper pressing frame 51. Each lateral board 522 of the paper pressing tray 52 is spaced from the inner side of the corresponding sidewall of the accommodating groove 511 of the paper pressing frame 51 to form an interstice 57 therebetween. The paper pressing tray 52 is capable of sliding upward and downward in the accommodating groove 511 of the paper pressing frame 51 by virtue of the two first guiding blocks 527 guided in the two first guiding grooves 514 and the two second guiding blocks 528 guided in the two second guiding grooves 515.

Referring to FIG. 2, one end of each swing arm 54 of the paper pressing assembly 50 has a rectangular arm portion 541 and the other end of each swing arm 54 has a ring-shaped fastening ring 542. One side surface of a free end of the arm portion 541 is connected with a cylindrical stopper portion 543. The swing arm 54 is mounted to the gear shaft 53 of the paper pressing assembly 50. The fastening ring 542 is fastened to one end of the gear shaft 53 with the arm portion 541 accommodated in the interstice 57, and the stopper portion 543 inserted into the sliding groove 526 and being capable of sliding forward and rearward along the sliding groove 526.

Referring to FIG. 2, one end of the elastic element 55 is accommodated in the locating barrel 525 and the other end of the elastic element 55 is worn around the fastening pillar 518 so as to elastically restrain the elastic element 55 between the paper pressing frame 51 and the paper pressing tray 52.

Referring to FIG. 1 and FIG. 2, the stopper assembly 60 is assembled to the paper pressing tray 52 and the paper pressing frame 51, specifically, two opposite sides of the stopper assembly 60 are mounted to the two movable holes 529 of the paper pressing tray 52 and the stopper assembly 60 is limited in the locating groove 510 of the paper pressing frame 51. The stopper assembly 60 includes a blocking element 61 and a connecting element 62. The blocking element 61 is disposed perpendicular to the paper supply tray 30 and is assembled to the paper pressing frame 51. One end of the connecting element 62 is pivotally mounted to the paper pressing tray 52 and the other end of the connecting element 62 is pivotally mounted to a top of the blocking element 61. The driving device rotates anticlockwise to make a transmitting mechanism (not shown) engage with the drive gear 21 of the gear assembly 20, the drive gear 21 of the gear assembly 20 drives the transmission gear 22 and the gear shaft 53 to rotate clockwise to bring along the swing arm 54 to swing and pull the paper pressing tray 52 to raise up to flush with a bottom surface of the paper pressing frame 51. Simultaneously, it needs to conquer an elastic potential energy of the elastic element 55. The connecting element 62 drives the blocking element 61 to move downward to make the blocking element 61 located in a paper blocking position for realizing a paper blocking function so as to facilitate placing the paper on the paper supply tray 30.

Referring to FIG. 1 and FIG. 2, then, the driving device rotates clockwise to make the transmitting mechanism break away from the drive gear 21 of the gear assembly 20 such as to cancel a binding force of the swing arm 54 raising up the paper pressing tray 52. The gear assembly 20 transmits another driving force generated by the driving device to the pickup assembly 40 to pick up the paper, the elastic element 55 is capable of elastically pushing against the paper pressing frame 51 to move downward and a paper blocking function is disappeared by virtue of the connecting element 62 driving the blocking element 61 to move upward. Specifically, the blocking element 61 has a rectangular board-shaped base board 611, two arc-shaped pivoting portions 612 arched downward from two opposite sides of a top of the base board 611, and two paper blocking portions 613 extending downward from two opposite sides of a bottom of the base board 611. The base board 611 is accommodated in the locating groove 510 and is capable of sliding upward and downward along the locating groove 510. The connecting element 62 of the stopper assembly 60 shows an arc board shape. The protruding pillars 516 of the paper pressing frame 51 project under the connecting element 62 to make the connecting element 62 proceed a circular arc curve movement along the protruding pillars 516. Two opposite sides of a front of the connecting element 62 extend outward to form two pivoting pillars 621. Two opposite sides of a rear of the connecting element 62 are connected with two pivoting portions 622. The connecting element 62 is pivotally mounted to the paper pressing tray 52 by virtue of the two pivoting pillars 621 being pivoted in the two movable holes 529. The two pivoting portions 622 are pivoted in the two arc-shaped pivoting portions 612 to make the connecting element 62 pivotally mounted to the blocking element 61.

Referring to FIG. 1 to FIG. 4, a working principle of the automatic test system 100 is described as follows.

When the automatic test system 100 is started, the driving device rotates anticlockwise to make the transmitting mechanism (not shown) engage with the drive gear 21 of the gear assembly 20, the drive gear 21 drives the transmission gear 22 and the gear shaft 53 to rotate clockwise. The stopper portion 543 of the swing arm 54 pivots around the gear shaft 53 to rotate upward by virtue of the gear shaft 53 bringing along the swing arm 54 to rotate clockwise and pull the paper pressing tray 52 to raise up to flush with the bottom surface of the paper pressing frame 51. A continuous motive power generated by the connecting element 62 drives the front of the connecting element 62 to move downward so as to bring along the blocking element 61 to move downward and the two paper blocking portions 613 projecting into the blocking grooves 31. At this case, the paper pressing assembly 50 is raised up, the blocking element 61 moves downward to realize the paper blocking function for facilitating placing a stack of paper on the paper supply tray 30.

The stack of paper is put on the paper supply tray 30, the two paper blocking portions 613 of the blocking element 61 is perpendicular to the paper supply tray 30 and project into the blocking grooves 31 to limit the paper to be transmitted inward.

When the stack of paper is put on the paper supply tray 30, the stack of paper triggers a sensor (not shown), the driving device rotates clockwise, the transmitting mechanism breaks away from the drive gear 21 of the gear assembly 20, the binding force of the driving device driving the paper pressing assembly 50 is disappeared, the elastic element 55 pushes against the paper pressing tray 52 to move downward by use of the elastic potential energy, the stopper portion 543 of the swing arm 54 slides in the sliding groove 526 and swings downward until the paper pressing roller 56 presses downward on the paper located above the pickup roller 41, and provides a positive force which is needed by the pickup roller 41 to pick up the paper, simultaneously, the connecting element 62 proceeds the circular arc curve movement along the protruding pillars 516, the front of the connecting element 62 which is pivotally mounted to the paper pressing tray 52 moves downward, and the rear of the connecting element 62 which is pivotally mounted to the blocking element 61 is raised up to bring along the blocking element 61 to move upward, so that the two paper blocking portions 613 of the blocking element 61 break away from the blocking grooves 31 of the paper supply tray 30 to raise up for making the paper blocking function of the blocking element 61 of the stopper assembly 60 disappeared and the paper be transmitted inward.

After completing picking up the paper, the driving device rotates anticlockwise, the paper pressing assembly 50 is raised up to restore a status before picking up the paper, the two paper blocking portions 613 returns to the paper blocking position.

As described above, the drive gear 21 of the gear assembly 20 drives the transmission gear 22 and the gear shaft 53 to rotate to bring along the swing arm 54 to swing and pull the paper pressing tray 52 to raise up to flush with the bottom surface of the paper pressing frame 51, simultaneously, the elastic potential energy of the elastic element 55 is needed be conquered, the connecting element 62 drives the blocking element 61 to move downward to make the blocking element 61 realize the paper blocking function so as to facilitate placing the paper on the paper supply tray 30, the drive gear 21 of the gear assembly 20 breaks away from the drive gear 21, the binding force of the paper pressing assembly 50 is disappeared, the elastic element 55 pushes against the paper pressing tray 52 to move downward, the blocking element 61 breaks away from the paper supply tray 30 to raise up for making the paper blocking function of the blocking element 61 of the stopper assembly 60 disappeared for facilitating picking up the paper. The paper feeding mechanism 100 realizes the paper feeding function by virtue of the gear assembly 20 transmitting the driving force generated by one motor to the pickup assembly 40, the paper pressing assembly 50 and the stopper assembly 60 so as to make the paper feeding mechanism 100 have a simpler structure and a lower manufacturing cost.

What is claimed is:

1. A paper feeding mechanism, comprising:

a mechanical frame;

a gear assembly mounted to the mechanical frame, and the gear assembly including a drive gear, and a transmission gear engaged with the drive gear;

a paper supply tray, a rear end of the paper supply tray being pivoted to the mechanical frame;

a pickup assembly assembled to the mechanical frame and the paper supply tray, and a top of the pickup assembly projecting above a top surface of the paper supply tray;

a paper pressing assembly driven by the gear assembly, and mounted to the mechanical frame and located above the paper supply tray, the paper pressing assembly including a paper pressing frame disposed above the paper supply tray, a paper pressing tray mounted inside of the paper pressing frame, a gear shaft mounted to the paper pressing frame and connected with the transmission gear, at least one swing arm mounted to the gear shaft, and an elastic element elastically restrained between the paper pressing frame and the paper pressing tray, one end of the swing arm being mounted to one end of the gear shaft, and the other end of the swing arm being driven by the gear shaft to rotate around the gear shaft and horizontally slide in the paper pressing tray; and a stopper assembly being assembled to the paper pressing tray and the paper pressing frame, the stopper assembly including a blocking element and a connecting element, the blocking element being disposed perpendicular to the paper supply tray and being assembled to the paper pressing frame, one end of the connecting element being pivotally mounted to the paper pressing tray and the other end of the connecting element being pivotally mounted to a top of the blocking element, wherein the drive gear of the gear assembly rotates to a rotational position to drive the transmission gear and the gear shaft to rotate to bring along the swing arm to swing and pull the paper pressing tray to raise up to flush with a bottom surface of the paper pressing frame, simultaneously, an elastic potential energy of the elastic element is overcome, in the process of the paper pressing tray raising, the connecting element drives the blocking element to move downward and a paper blocking function is achieved by the blocking element, when feeding, the drive gear of the gear assembly is set free from an external driving force, the elastic element pushes against the paper pressing tray to move downward, the blocking element is raised up such as to be separated from the paper supply tray, thereby cancelling the paper blocking function of the blocking element of the stopper assembly.

2. The paper feeding mechanism as claimed in claim 1, wherein the paper pressing frame of the paper pressing assembly defines an accommodating groove, two rears of two inner surfaces of two opposite sidewalls of the accommodating groove protrude face to face to form two blocking pieces, the two blocking pieces are spaced from a rear sidewall of the accommodating groove to form two first guiding grooves, and two opposite sides of an inner surface of a front sidewall of the accommodating groove define two second guiding grooves, the paper pressing tray of the paper pressing assembly is slidably assembled to the accommodating groove, the paper pressing tray has a bottom board, two lateral boards and a front board, two rears of the two opposite sidewalls of the accommodating groove protrude outward to form two first guiding blocks, two opposite sides of the front board protrude upward and then protrude forward to form two second guiding blocks, the paper pressing tray is capable of sliding upward and downward in the accommodating groove by virtue of the two first guiding blocks guided in the two first guiding grooves and the two second guiding blocks guided in the two second guiding grooves.

3. The paper feeding mechanism as claimed in claim 2, wherein two fronts of the two opposite sidewalls of the accommodating groove of the paper pressing frame define two pivoting holes, two opposite sides of the gear shaft of the paper pressing assembly are pivoted in the two pivoting holes.

4. The paper feeding mechanism as claimed in claim 2, wherein two tops of the two opposite sidewalls of the accommodating groove of the paper pressing frame extend towards each other to form a blocking board, a bottom surface of the blocking board protrudes downward to form a fastening pillar, the paper pressing tray has a bottom board, a front of a top surface of the bottom board protrudes upward to form a locating barrel, one end of the elastic element is accommodated in the locating barrel and the other end of the elastic element is worn around the fastening pillar so as to elastically restrain the elastic element between the paper pressing frame and the paper pressing tray.

5. The paper feeding mechanism as claimed in claim 2, wherein two middles of the two opposite sidewalls of the accommodating groove of the paper pressing frame define two sliding grooves penetrating therethrough, each lateral board of the paper pressing tray is spaced from the inner side of the corresponding sidewall of the accommodating groove to form an interstice therebetween, one end of each swing arm of the paper pressing assembly has an arm portion and the other end of each swing arm has a ring-shaped fastening ring, one side surface of a free end of the arm portion is connected with a stopper portion, the swing arm is mounted to the gear shaft of the paper pressing assembly, the fastening ring is fastened to one end of the gear shaft with the arm portion accommodated in the interstice, and the stopper portion inserted into the sliding groove and being capable of sliding forward and rearward along the sliding groove.

6. The paper feeding mechanism as claimed in claim 2, wherein a middle of the rear sidewall of the accommodating groove of the paper pressing frame defines an avoiding groove, a rear of the paper pressing frame defines a locating groove communicating with the avoiding groove, the blocking element has a base board, two arc-shaped pivoting portions arched downward from two opposite sides of a top of the base board, and two paper blocking portions extending downward from two opposite sides of a bottom of the base board, the base board is accommodated in the locating groove and is capable of sliding upward and downward along the locating groove.

7. The paper feeding mechanism as claimed in claim 6, wherein two inner surfaces of the two opposite sidewalls of the accommodating groove of the paper pressing frame protrude face to face to form two protruding pillars, the connecting element of the stopper assembly shows an arc board shape, the protruding pillars of the paper pressing frame project under the connecting element to make the connecting element proceed a circular arc curve movement along the protruding pillars, two opposite sides of a front of the connecting element extend outward to form two pivoting pillars, two opposite sides of a rear of the connecting element are connected with two pivoting portions, the connecting element is pivotally mounted to the paper pressing tray by virtue of the two pivoting pillars being pivoted in the two movable holes, the two pivoting portions are pivoted in the two arc-shaped pivoting portions to make the connecting element pivotally mounted to the blocking element.

8. The paper feeding mechanism as claimed in claim 6, wherein the paper supply tray defines two separating grooves, two blocking grooves located between the two separating grooves, the two paper blocking portions of the blocking element is perpendicular to the paper supply tray and project into the blocking grooves.

9. The paper feeding mechanism as claimed in claim 8, wherein the paper supply tray defines a picking groove located in front of the two blocking grooves, the pickup assembly includes a pickup roller, and a plurality of separating rollers located behind the pickup roller, the pickup roller passes through the picking groove of the paper supply tray with a top thereof projecting beyond the top surface of the paper supply tray and a bottom thereof projecting under the bottom surface of the paper supply tray, each of the separating rollers passes through the separating groove of the paper supply tray with a top thereof projecting beyond the top surface of the paper supply tray.

10. The paper feeding mechanism as claimed in claim 1, wherein the paper pressing assembly includes a paper pressing roller, the paper pressing tray has a bottom board, a rear of a top surface of the bottom board defines a pivoting groove vertically penetrating therethrough, the paper pressing roller is pivoted in the pivoting groove with a bottom thereof projecting under the bottom board of the paper pressing tray.

* * * * *